US006059538A

United States Patent [19]

Kawaguchi et al.

[11] Patent Number: 6,059,538

[45] Date of Patent: May 9, 2000

[54] CONTROL VALVE FOR VARIABLE DISPLACEMENT COMPRESSOR

[75] Inventors: Masahiro Kawaguchi; Kenji Takenaka; Ken Suitou; Yoshihiro Makino, all of Kariya, Japan

[73] Assignee: Kabushiki Kaisha Toyoda Jidoshokki Seisakusho, Aichi-Ken, Japan

[21] Appl. No.: 09/130,235

[22] Filed: Aug. 6, 1998

[30] Foreign Application Priority Data

Aug. 8, 1997 [JP] Japan ..... 9-214999

[51] Int. Cl.[7] ..... F04B 1/26; F16K 31/00

[52] U.S. Cl. ..... 417/222.2; 251/64; 251/337

[58] Field of Search ..... 417/222.2, 270; 251/64, 337

[56] References Cited

U.S. PATENT DOCUMENTS

| | | | |
|---|---|---|---|
| 4,723,891 | 2/1988 | Takenaka et al. | 417/222.2 |
| 4,875,832 | 10/1989 | Suzuki et al. | 417/222.2 |
| 5,518,374 | 5/1996 | Ota et al. | 417/222.2 |
| 5,620,310 | 4/1997 | Takenaka et al. | 417/222.2 |
| 5,762,476 | 6/1998 | Ota et al. | 417/222.2 |
| 5,924,443 | 6/1999 | Wohlfahrt | 137/505 |
| 5,967,487 | 10/1999 | Cook et al. | 251/64 |
| 5,975,859 | 11/1999 | Kawaguchi et al. | 417/222.2 |

FOREIGN PATENT DOCUMENTS 5-172049 7/1993 Japan .

*Primary Examiner*—Teresa Walberg
*Assistant Examiner*—Jeffrey Pwu
*Attorney, Agent, or Firm*—Morgan & Finnegan, L.L.P.

[57] ABSTRACT

An improved displacement control valve incorporated in a variable displacement compressor. The control valve is installed in an accommodating hole formed in a rear housing of the compressor. A cap is attached to a housing body of the control valve. A pressure sensing chamber is defined between the cap and the housing body. A pressure sensing member, or bellows, is located in the pressure sensing chamber. The bellows moves a valve body in accordance with pressure introduced into the pressure sensing chamber. A tubular protector, which is made of an elastic material, is attached to the cap. The control valve is installed in the rear housing by inserting the valve, cap first, into the accommodating hole. During this installation, the protector prevents the cap from directly contacting the housing or inner wall of the accommodating hole. The cap is therefore not deformed. The performance of the control valve is therefore improved.

20 Claims, 5 Drawing Sheets

CONTROL VALVE FOR VARIABLE DISPLACEMENT COMPRESSOR

BACKGROUND OF THE INVENTION

The present invention relates to variable displacement compressors that are used, for example, in vehicle air conditioners. More particularly, the present invention pertains to a displacement control valve for controlling displacement of a variable displacement compressor.

A typical variable displacement compressor includes a drive shaft that is rotatably supported in its housing. The housing includes a cylinder block having cylinder bores. Each cylinder bore reciprocally houses a piston. A crank chamber is also defined in the housing. The crank chamber accommodates a swash plate. The swash plate is supported on the drive shaft to rotate integrally with and to tilt with respect to the drive shaft. Rotation of the swash plate reciprocates the pistons thereby causing the pistons to draw refrigerant gas from a suction chamber into the cylinder bores and to compress the gas. The pistons then discharge the compressed gas from the cylinder bores to a discharge chamber.

The crank chamber is connected with a suction chamber by a bleeding passage. The bleeding passage includes a displacement control valve. The control valve regulates the bleeding passage for controlling the amount of refrigerant gas supplied from the crank chamber to the suction chamber thereby controlling the pressure in the crank chamber. Changes in the pressure in the crank chamber alter the pressure difference between the crank chamber and the cylinder bores. The alteration of the pressure difference changes the inclination of the swash plate. Accordingly, the displacement of the compressor is varied.

Japanese Unexamined Patent Publication No 5-172049 discloses such a displacement control valve. As shown in FIG. 7, a control valve 111 is accommodated in a hole 119*a* formed in the housing 119 of a compressor. The hole 119*a* functions as a part of a bleeding passage 118 that connects a crank chamber 115 with a suction chamber 120. The control valve 111 is therefore located in the bleeding passage 118. The control valve 111 has a cylindrical cover 112. The cover 112 defines a pressure sensing chamber 113. The pressure sensing chamber 113 is connected to the crank chamber 115 by pressure introduction holes 114. A pressure sensing member, or bellows 116, is housed in the pressure sensing chamber 113 and is coupled to a valve body 117. The bellows 116 moves the valve body 117 based on the pressure of refrigerant gas introduced into the pressure sensing chamber 113 from the crank chamber 115. In this manner, the control valve 111 controls the flow rate of refrigerant gas in the bleeding passage 118.

When mating the control valve 111 with the housing 119, the cover 112 is first inserted in the hole 119*a*. The cover 112 may hit the opening and the inner wall of the hole 119*a*. This may deform the cover 112. Deformation of the cover 112 may displace the bellows 116 from a predetermined position in the cover 112. The responsiveness of the valve body 117 to the pressure in the chamber 113 is determined by the position of the bellows 116 in the cover 112. Thus, if the bellows 116 is displaced from the predetermined position, the desired operational characteristics of the control valve 11 are not obtained. As a result, the displacement of the compressor is not accurately controlled. The displacement of the bellows 116 also hinders the movement of the bellows 116 and the valve body 117.

SUMMARY OF THE INVENTION

Accordingly, it is an objective of the present invention to provide a displacement control valve for variable displacement compressors that maintains its operational characteristics even if it is hit during installation.

To achieve the foregoing and other objectives and in accordance with the purpose of the present invention, a control valve in a variable displacement compressor that adjusts the discharge displacement in accordance with the inclination of a drive plate located in a crank chamber is provided. The compressor includes a piston connected to the drive plate, the piston being located in a cylinder bore. The inclination of the drive plate varies according to the difference between the pressure in the crank chamber and the pressure in the cylinder bore. The control valve regulates the difference between the pressure in the crank chamber and the pressure in the cylinder bore in accordance with an operating pressure. The operating pressure is the pressure in a selected chamber of the compressor. The control valve includes a housing body, a valve body, a cap, a pressure sensing member and a protector. The valve body is movably accommodated in the housing body to adjust the valve opening amount. The cap is attached to the housing body to define a pressure chamber. The pressure chamber is exposed to the operating pressure. The pressure sensing member is located in the pressure chamber. The pressure sensing member moves the valve body in accordance with the operating pressure in the pressure chamber. The protector is attached to the cap to protect the cap from impact.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

FIG. 3(*b*) is a cross-sectional view taken along line 3(*b*)—3(*b*) of FIG. 3(*a*);

DETAILED DESCRIPTION OF THE PREFERRED EMBODIMENTS

Figure 1:
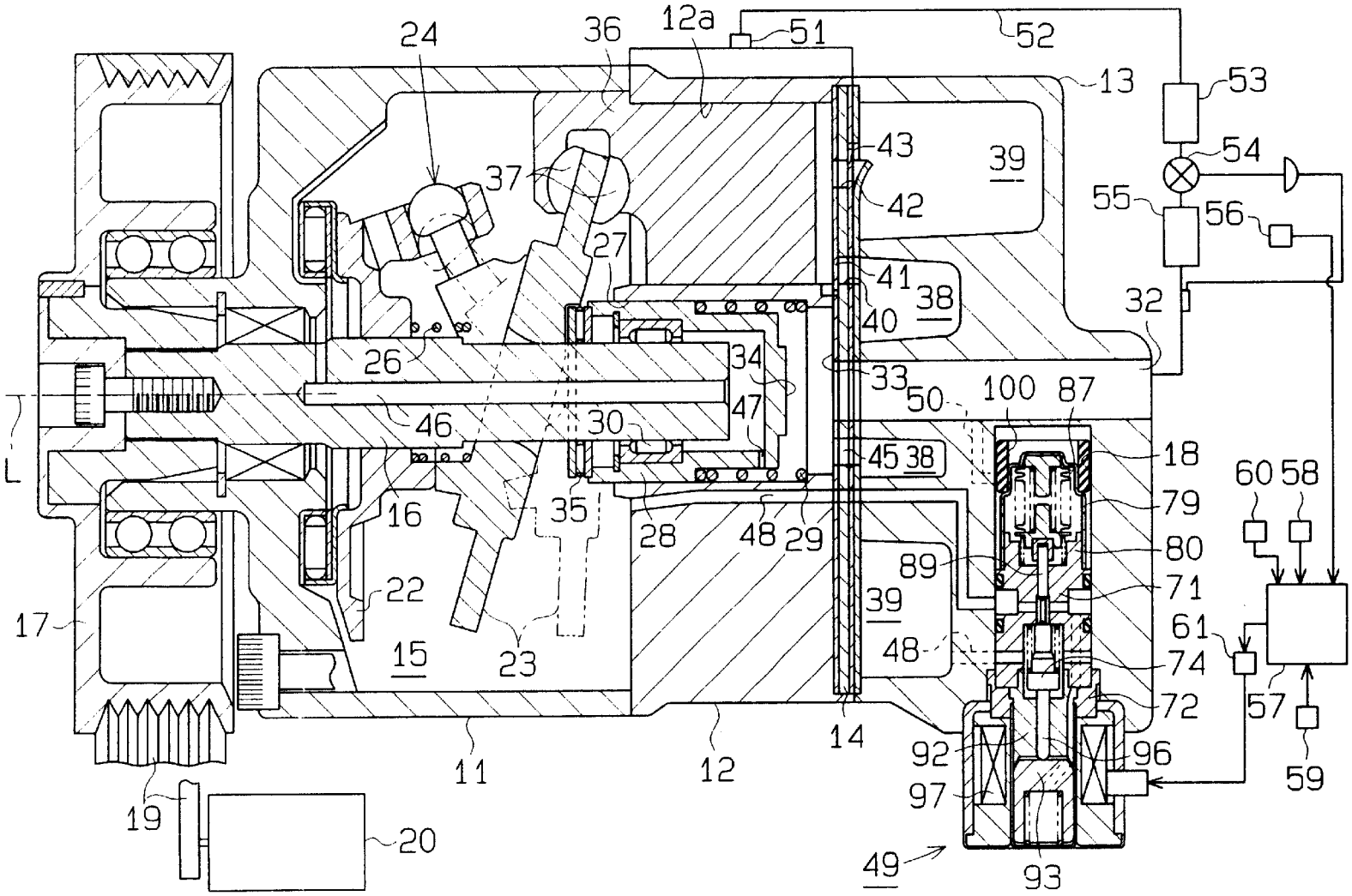
FIG. 1 is a cross-sectional view illustrating a variable displacement compressor according to a first embodiment of the present invention.

A variable displacement compressor according to a first embodiment of the present invention will now be described. As shown in FIG. 1, a front housing 11 is secured to the front end face of a center housing, or cylinder block 12. A rear housing 13 is secured to the rear end face of the cylinder block 12, and a valve plate 14 is located between the rear housing 13 and the rear end face. A crank chamber 15 is defined by the inner walls of the front housing 11 and the front end face of the cylinder block 12.

A drive shaft 16 is rotatably supported in the front housing 11 and the cylinder block 12 to extend through the crank chamber 15. The front housing 11 has a cylindrical wall, or boss, extending forward. The front end of the drive shaft 16 is surrounded by the boss and is secured to a pulley 17. The pulley 17 is rotatably supported by the boss. The pulley 17 is directly coupled to an external drive source (a vehicle engine 20 in this embodiment) by a belt 19. The compressor of FIG. 1 is referred to as a clutchless type variable displacement compressor since it is not clutched on and off.

A rotor 22 is fixed to the drive shaft 16 in the crank chamber 15 to integrally rotate with the drive shaft 16. A drive plate, or swash plate 23, is supported by the drive shaft 16 in the crank chamber 15 to slide along and to tilt with respect to the axis L of the shaft 16. The swash plate 23 is coupled to the rotor 22 by a hinge mechanism 24. The hinge mechanism 24 causes the swash plate 23 to rotate integrally with the drive shaft 16. The hinge mechanism 24 also guides the movement of the swash plate 23 along the axis L of the drive shaft 16 and guides the inclination of the swash plate 23 with respect to the drive shaft 16. As the swash plate 23 slides rearward toward the cylinder block 12, the inclination of the swash plate 23 decreases.

A coil spring 26 is located between the rotor 22 and the swash plate 23. The spring 26 urges the swash plate 23 rearward, or in a direction decreasing the inclination of the swash plate 23. Abutment of the swash plate 23 against the rotor 22 limits the maximum inclination of the swash plate 23.

The cylinder block 12 has a shutter chamber 27 at its center portion. The shutter chamber 27 extends along the axis L of the drive shaft 16. A cup-shaped shutter 28 is accommodated in the shutter chamber 27. The shutter 28 slides along the axis L of the drive shaft 16. A coil spring 29 is located between a step formed in the circumference of the shutter 28 and a step formed in the shutter chamber 27. The coil spring 29 urges the shutter 28 toward the swash plate 23.

The rear end of the drive shaft 16 is inserted in the shutter 28. The shutter 28 has a radial bearing 30 fixed to its inner wall. The radial bearing 30 slides with the shutter 28 relative to the drive shaft 16. The rear end of the drive shaft 16 is thus supported by the inner wall of the shutter chamber 27 with the radial bearing 30 and the shutter 28 in between.

A suction passage 32 is defined at the center portion of the rear housing 13 and the valve plate 14. The passage 32 extends along the axis L of the drive shaft 16 and communicates with the shutter chamber 27. A positioning surface 33 is formed on the valve plate 14 about the inner opening of the suction passage 32. The rear end of the shutter 28 functions as a shutting surface 34, which abuts against the positioning surface 33. Abutment of the shutting surface 34 against the positioning surface 33 prevents the shutter 28 from further moving rearward away from the rotor 22. The abutment also disconnects the suction passage 32 from the shutter chamber 27.

A thrust bearing 35 is supported on the drive shaft 16 and is located between the swash plate 23 and the shutter 28. The thrust bearing 35 slides along the axis L of the drive shaft 16. The force of the coil spring 29 constantly urges the thrust bearing 35 against the swash plate 23 with the shutter 28.

The swash plate 23 moves rearward as its inclination decreases. As it moves rearward, the swash plate 23 pushes the shutter 28 rearward with the thrust bearing 35. Accordingly, the shutter 28 moves toward the positioning surface 33 against the force of the coil spring 29. When the swash plate 23 reaches the minimum inclination as illustrated by a two-dot chain line in FIG. 1, the shutting surface 34 abuts against the positioning surface 33. In this state, the shutter 28 is located at the closed position for disconnecting the shutter chamber 27 from the suction passage 32. The minimum inclination of the swash plate 23 is slightly more than zero degrees. Zero degrees refers to the angle of the swash plate 23 with respect to a plane perpendicular to the axis L of the rotary shaft 16.

Cylinder bores 12*a* extend through the cylinder block 12. The cylinder bores 12*a* extend parallel to the axis L of the drive shaft 16 and are angularly spaced apart at equal intervals about the axis L. A single-headed piston 36 is accommodated in each cylinder bore 12*a*. Each piston 36 is operably coupled to the swash plate 23 by a pair of shoes 37. The swash plate 23 is rotated by the rotary shaft 16 through the rotor 22. Rotation of the swash plate 23 is transmitted to each piston 36 through the shoes 37 and is converted to linear reciprocation of each piston 36 in the associated cylinder bore 12*a*.

An annular suction chamber 38 is defined in the center portion of the rear housing 13 about the suction passage 32. An annular discharge chamber 39 is defined about the suction chamber 37 in the rear housing 13. Suction ports 40 and discharge ports 42 are formed in the valve plate 14. Each suction port 40 and each discharge port 42 correspond to one of the cylinder bores 12*a*. Suction valve flaps 41 are formed on the valve plate 14. Each suction valve flap 41 corresponds to one of the suction ports 40. Discharge valve flaps 43 are formed on the valve plate 14. Each discharge valve flap 43 corresponds to one of the discharge ports 42.

As each piston 36 moves from the top dead center to the bottom dead center, refrigerant gas in the suction chamber 38 is drawn into its cylinder bore 12*a* through the associated suction port 40 while causing the associated suction valve flap 41 to flex to an open position. As each piston 36 moves from the bottom dead center to the top dead center in the associated cylinder bore 12*a*, refrigerant gas is compressed in the cylinder bore 12*a* and is discharged to the discharge chamber 39 through the associated discharge port 42 while causing the associated discharge valve flap 43 to flex to an open position.

The suction chamber 38 is connected with the shutter chamber 27 by a communication hole 45 formed in the valve plate 14. When contacting the positioning surface 33, the shutting surface 34 disconnects the hole 45 from the suction passage 32. The drive shaft 16 has a pressure release passage, or axial passage 46. The axial passage 46 connects the crank chamber 15 with the interior of the shutter 28. A pressure release hole 47 is formed in the shutter wall near the rear end of the shutter 28 for connecting the interior of the shutter 28 with the shutter chamber 27.

A supply passage 48 is defined in the rear housing 13, the valve plate 14 and the cylinder block 12 for connecting the discharge chamber 39 with the crank chamber 15. A displacement control valve 49 is accommodated in the rear housing 13 to regulate the supply passage 48. A gas introduction passage 50 is defined in the rear housing 13 for connecting the control valve 49 with the suction passage 32.

An outlet port 51 is formed in the cylinder block 12 and is communicated with the discharge chamber 39. The outlet port 51 is connected to the suction passage 32 by an external refrigerant circuit 52. The refrigerant circuit 52 includes a condenser 53, an expansion valve 54 and an evaporator 55.

A controller 57 is connected to various devices including a temperature sensor 56, a temperature adjuster 58, a passenger compartment temperature sensor 59 and an air conditioner starting switch 60. The temperature sensor 56 is located in the vicinity of the evaporator 55 for detecting the temperature of the evaporator 55. A passenger sets a desirable compartment temperature, or a target temperature, by the temperature adjuster 58. The controller 57 receives various information including a target temperature set by the temperature adjuster 58, the temperature detected by the temperature sensor 56, the passenger compartment temperature detected by the temperature sensor 59 and an ON/OFF signal from the starting switch 60. Based on this information, the controller 57 computes the value of a current supplied to a driver 61. Accordingly, the driver 61 sends a current having the computed value to the control valve 49. In addition to the above listed data, the controller 57 may use other data such as the temperature outside the compartment and the engine speed for determining the magnitude of electric current sent to the control valve 49.

Figure 2:
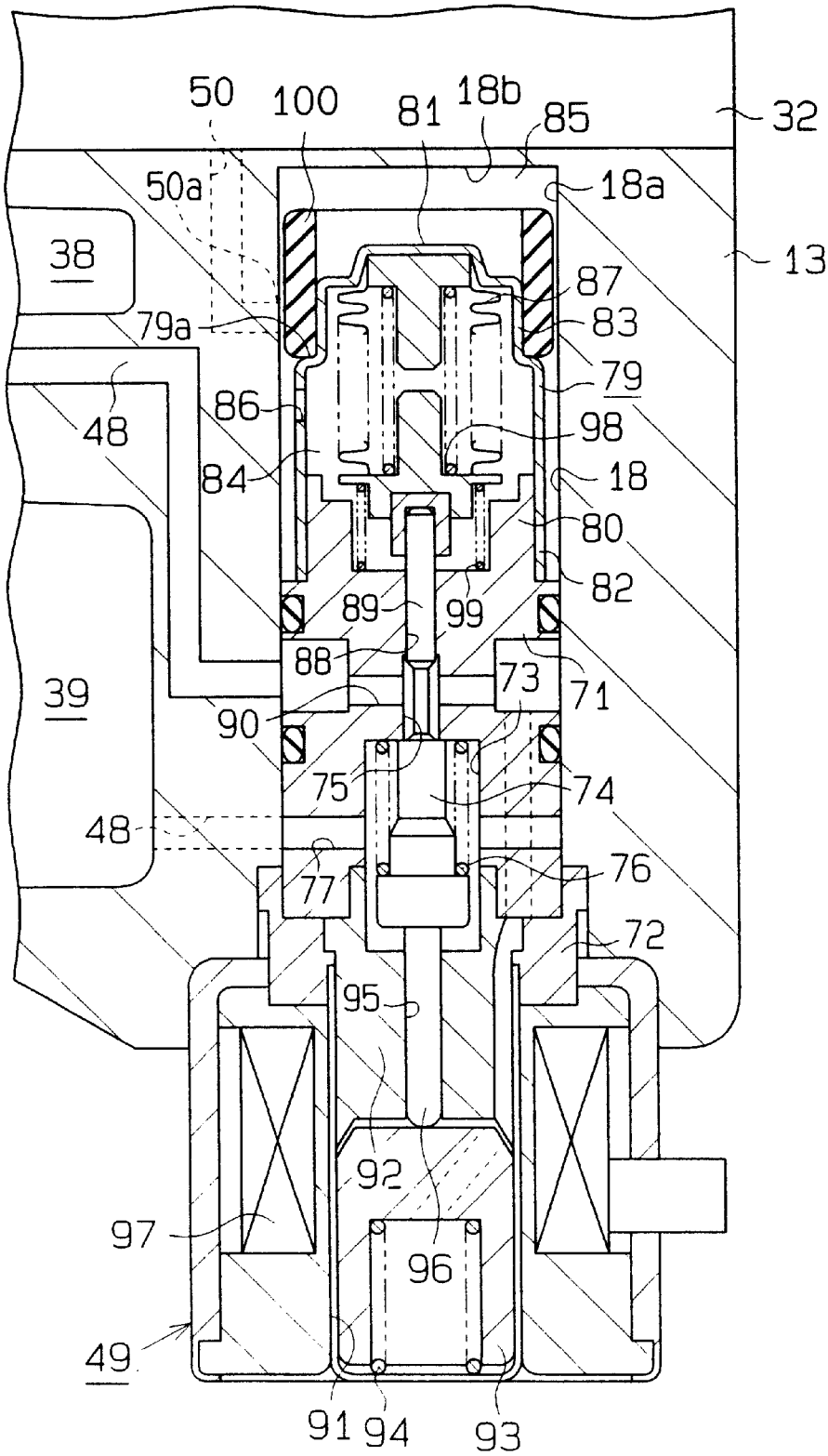
FIG. 2 is an enlarged partial cross-sectional view illustrating a displacement control valve in the compressor of FIG. 1.

The structure of the control valve 49 will now be described. As shown in FIG. 2, the control valve 49 includes a housing 71 and the solenoid 72, which are secured to each other. A cylindrical cap 79 is secured to the upper end of the housing 71. A blind hole 18 is formed in the rear housing 13. The control valve 49 is inserted in the hole 18 from the cap 79. When the control valve 49 is mated with the hole 18, a part of the solenoid 72 protrudes from the rear housing 13.

A valve chamber 73 is defined between the housing 71 and the solenoid 72. The valve chamber 73 is connected to the discharge chamber 39 by a port 77 and the upstream portion of the supply passage 48. A valve body 74 is arranged in the valve chamber 73. A valve hole 75 extends axially in the housing 71 and opens in the valve chamber 73. The opening of the valve hole 75 faces the valve body 74. An opening spring 76 extends between the valve body 74 and the a wall of the valve chamber 73 for urging the valve body 74 in a direction to open the valve hole 75.

A cylindrical wall 80 extends from the top of the housing 71. The cap 79, which has a closed upper end, is fitted to the outer circumferential surface of the cylindrical wall 80. The cap 79 includes a large diameter portion 82, a small diameter portion 83 and a top wall 81. The large diameter portion 82 is crimped to the cylindrical wall 80. The top wall 81 closes the upper end of the small diameter portion 83. A pressure sensing chamber 84 is defined between the housing 71 and the cap 79.

A space 85 is defined between the outer surface of the cap 79 and the wall of the hole 18. The gas introduction passage 50 opens to the hole 18 at an opening 50*a*. The opening 50*a* faces the small diameter portion 83 of the cap 79. The passage 50 connects the space 85 with the suction passage 32. The large diameter portion 82 has a port 86 for communicating the space 85 with the pressure sensing chamber 84. Therefore, the pressure sensing chamber 84 is exposed to the pressure of refrigerant gas in the suction passage 32 (the suction pressure) through the introduction passage 50, the space 85 and the port 86. The suction pressure is referred to as the "operating pressure".

The pressure sensing chamber 84 accommodates a pressure sensing member, or bellows 87. The bellows 87 includes a spring 98. The spring 98 urges the bellows 87 to extend axially, or lengthwise. A spring 99 extends between the bellows 87 and the housing 71. The spring 99 urges the bellows 87 axially toward the top wall 81 of the cap 79 thereby maintaining the orientation of the bellows 87. The axial position of the cap 79 relative to the cylindrical wall 80 is adjusted to determine the initial position of the bellows 87 in the axial direction relative to the valve housing 71. After determining the initial position of the bellows 87, the cap 79 is secured to the cylindrical wall 80.

A guide hole 88 is defined in the housing 71 between the pressure sensing chamber 84 and the valve hole 75. The axis of the guide hole 88 is aligned with the axis of the valve hole 75. The bellows 87 is connected to the valve body 74 by a rod 89. The guide rod 89 extends in and slides relative to the guide hole 88. The rod 89 is formed integrally with the valve body 74. The rod 89 is not fixed to the bellows 87 and may move axially relative to the bellows 87.

A port 90 is formed in the housing 71 between the valve chamber 73 and the sensing chamber 84. The port 90 extends transversely to and intersects the valve hole 75. The valve hole 75 is connected with the crank chamber 15 by the port 90 and the downstream portion of the supply passage 48.

The solenoid 72 includes a plunger chamber 91. A fixed iron core 92 is fitted to the upper opening of the plunger chamber 91. A cup-shaped plunger 93 is recriprocally accommodated in the plunger chamber 91. A follower spring 94 extends between the plunger 93 and the bottom of the plunger chamber 91. The force of the follower spring 94 is smaller than the force of the opening spring 76.

The fixed core 92 has a guide hole 95 extending between the plunger chamber 91 and the valve chamber 73. A solenoid rod 96 is formed integrally with the valve body 74. The rod 96 extends through and slides with respect to the guide hole 95. The springs 76 and 94 cause the lower end of the rod 96 to constantly contact the plunger 93. In other words, the valve body 74 moves integrally with the plunger 93 with the rod 96 in between.

A cylindrical coil 97 is wound about the core 92 and the plunger 93. The driver 61 supplies the coil 97 with a current having a value computed by the controller 57.

Figure 3A:
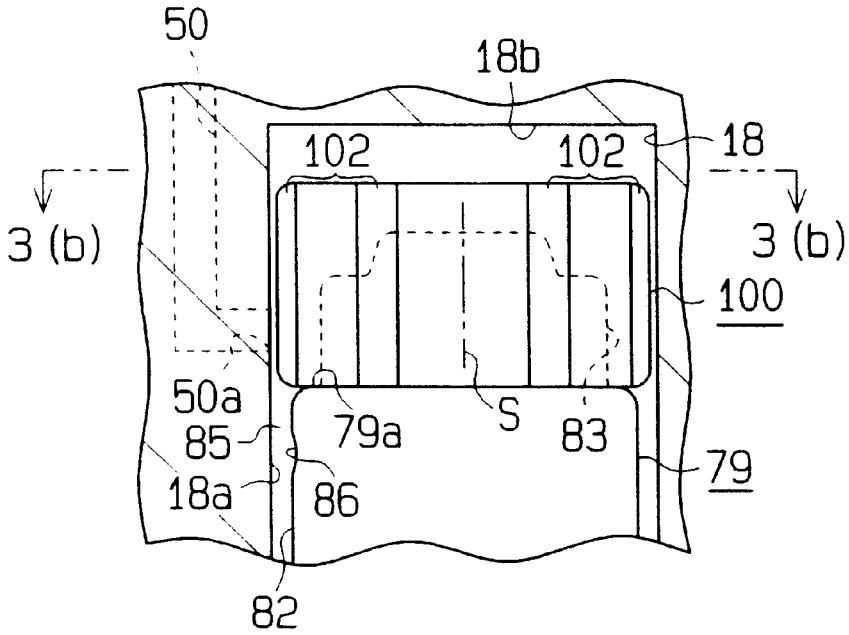
FIG. 3(*a*) is an enlarged partial front view, with the housing shown in cross section, illustrating a protector of the control valve of FIG. 2.
Figure 3B:
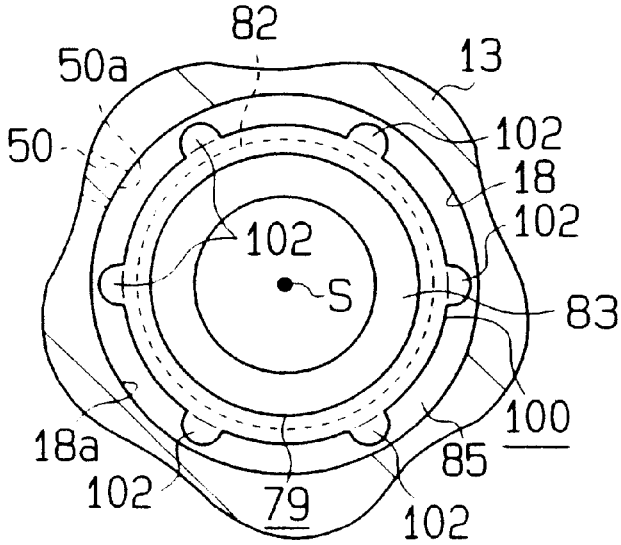

As shown in FIGS. 2, 3(*a*) and 3(*b*), a generally tubular protector 100 is fitted about the small diameter portion of the cap 79. The protector 100 is made of a shock absorbing elastomeric material such as a synthetic rubber. The inner diameter of the protector 100 is slightly smaller than the outer diameter of the small diameter portion 83. Therefore, the elastic force of the protector 100 fastens the protector 100 to the small diameter portion 83. The protector 100 is pressed against a step 79*a* defined between the large diameter portion 82 and the small diameter portion 83. The length of the protector 100 along its axis S is larger than the distance between the step 79*a* and the top wall 81 of the cap 79. Thus, the protector 100 completely protects the distal portion of the cap 79, or all but the large diameter portion 82. The distance between the top wall 81 of the cap 79 and the bottom surface 18*b* of the hole 18 is smaller than the length of the protector 100 along the axis S.

A plurality (six in the first embodiment) of projections 102 are formed integrally with the circumferential surface of the protector 100. The projections 102 extend along the axis S of the protector 100 and are spaced at equal angular intervals about the axis S. As shown in FIG. 3(*b*), each projection 102 has a semi-circular cross-section. The diameter of the protector 100 with the projections 102 is larger than the outer diameter of the large diameter portion 82 of the cap 79. Therefore, the outer circumferential surface of the large diameter portion 82 is located radially inside of the protector 100.

The operation of the compressor having the control valve 49 will now be described.

When the switch 60 is on, if the compartment temperature detected by the temperature sensor 59 is equal to or greater than a value set by the temperature adjuster 58, the controller 57 commands the driver 61 to excite solenoid 72. Accordingly, the driver 61 actuates the coil 97 with electric current having a certain magnitude. The current produces a magnetic attractive force between the fixed core 92 and the plunger 93 in accordance with the current magnitude. The attractive force is transmitted to the valve body 74 by the solenoid rod 96 and thus urges the valve body 74 against the force of the spring 76 in a direction closing the valve hole 75.

The suction pressure in the suction passage 32 is introduced to the pressure sensing chamber 84 through the introduction passage 50. The length of the bellows 87 varies in accordance with the suction pressure. The changes in the length of the bellows 87 is transmitted to the valve body 74 by the rod 89. The opening area between the valve body 74 and the valve hole 75 is determined by the equilibrium of a plurality of forces acting on the valve body 74. Specifically, the opening area is determined by the equilibrium position of the body 74, which is affected by the force of the solenoid 72, the force of the bellows 87 and the force of the spring 76.

When the cooling load is great, the temperature in the passenger compartment detected by the sensor 59 is higher than a target temperature set by the temperature adjuster 58. The controller 57 commands the driver 61 to increase the value of the current supplied to the coil 97 when there is a greater difference between the detected compartment temperature and the target temperature. A greater value of the current increases the magnitude of the attractive force between the fixed core 92 and the plunger 93 thereby increasing the resultant force urging the valve body 74 in a direction closing the valve hole 75. This lowers the value of suction pressure required for closing the valve hole 75. Thus, the valve body 74 controls the opening of the valve hole 75 based on a lower suction pressure. In other words, increasing the current value causes the valve 49 to maintain a lower suction pressure (which is equivalent to a target pressure).

A smaller opening area between the valve body 74 and the valve hole 75 decreases the amount of refrigerant gas flow from the discharge chamber 39 to the crank chamber 15 via the supply passage 48. The refrigerant gas in the crank chamber 15 flows into the suction chamber 38 via the axial passage 46 and the pressure release hole 47. As a result, the pressure in the crank chamber 15 is lowered. Further, when the cooling load is great, the suction pressure is high. Accordingly, the pressure in each cylinder bore 12*a* is high. Therefore, the difference between the pressure in the crank chamber 15 and the pressure in each cylinder bore 12*a* is small. This increases the inclination of the swash plate 23, thereby causing the compressor to operate at a larger displacement.

When the valve hole 75 is completely closed by the valve body 74, the supply passage 48 is closed. This stops the supply of highly pressurized refrigerant gas in the discharge chamber 39 to the crank chamber 15. Therefore, the pressure in the crank chamber 15 becomes substantially the same as that in the suction chamber 38. The inclination of the swash plate 23 thus becomes maximum and the compressor operates at the maximum displacement.

When the cooling load is small, the difference between the compartment temperature detected by the sensor 59 and a target temperature set by the temperature adjuster 58 is small. In this state, the controller 57 commands the driver 61 to decrease the magnitude of the current sent to the coil 97. A lower current magnitude decreases the attractive force between the fixed core 92 and the plunger 93 and thus decreases the resultant force that moves the valve body 74 in a direction closing the valve hole 75. This increases the value of suction pressure required for closing the valve hole 75. Thus, the valve body 74 controls the opening of the valve hole 75 based on a higher suction pressure. In other words, decreasing the current value causes the valve 49 to maintain a higher suction pressure (which is equivalent to a target pressure).

A larger opening area between the valve body 74 and the valve hole 75 increases the amount of refrigerant gas flow from the discharge chamber 39 to the crank chamber 15. As a result, the pressure in the crank chamber 15 is increased. Further, when the cooling load is small, the suction pressure is low. Accordingly, the pressure in each cylinder bore 12*a* is low. Therefore, the difference between the pressure in the crank chamber 15 and the pressure in each cylinder bore 12*a* is great. The greater pressure difference decreases the inclination of the swash plate 23, thereby causing the compressor to operate at a small displacement.

As the cooling load approaches zero, the temperature of the evaporator 55 drops to a frost forming temperature. When the temperature sensor 56 detects a temperature that is lower than or equal to the frost forming temperature, the controller 57 changes the current value, which is transmitted to the driver 61, to zero thereby de-exciting the solenoid 72. The driver 61 then stops sending current to the coil 97. This eliminates the magnetic attractive force between the core 92 and the plunger 93.

The valve body 74 is then moved in a direction opening the valve hole 75 by the force of the opening spring 76 against the force of the follower spring 94 transmitted by the plunger 93 and the rod 96. As a result, the opening area between the valve body 74 and the valve hole 75 is maximized. The gas flow from the discharge chamber 39 to the crank chamber 15 is increased, accordingly. This further raises the pressure in the crank chamber 15 thereby minimizing the inclination of the swash plate 23. The compressor thus operates at the minimum displacement.

When the switch 60 is turned off, the controller 57 commands the driver 61 to de-excite the solenoid 72. This also minimizes the inclination of the swash plate 23.

As described above, when the current value is increased, the valve body 74 causes the opening area of the valve hole 75 to be controlled based on a lower suction pressure. When the current value is decreased, on the other hand, the valve body 74 causes the opening area of the valve hole 75 to be controlled based on a higher suction pressure. The compressor controls the inclination of the swash plate 23 to adjust its displacement thereby maintaining a target suction pressure. That is, the control valve 49 changes a target value of the suction pressure in accordance with the current value. A compressor equipped with the control valve 49 varies the refrigeration level of the air conditioner.

When the inclination of the swash plate 23 is minimum, the shutting surface 34 of the shutter 28 abuts against the positioning surface 33. The abutment limits the minimum inclination of the swash plate 23. The abutment also disconnects the suction passage 32 from the suction chamber 38. This stops the gas flow from the refrigerant circuit 52 to the suction chamber 38 thereby stopping the circulation of refrigerant gas between the circuit 52 and the compressor.

The minimum inclination of the swash plate 23 is slightly more than zero degrees. Therefore, even if the inclination of the swash plate 23 is minimum, refrigerant gas in the cylinder bores 12*a* is discharged to the discharge chamber 39 and the compressor operates at the minimum displacement. The refrigerant gas discharged to the discharge chamber 39 from the cylinder bores 12*a* is drawn into the crank chamber 15 through the supply passage 48. The refrigerant gas in the crank chamber 15 is drawn back into the cylinder bores 12*a* through the axial passage 46, the pressure release hole 47 and the suction chamber 38. That is, when the inclination of the swash plate 23 is minimum, refrigerant gas circulates within the compressor traveling through the discharge chamber 39, the supply passage 48, the crank chamber 15, the axial passage 46, the pressure release hole 47, the suction chamber 38 and the cylinder bores 12*a*. This circulation of refrigerant gas causes the lubricant oil contained in the gas to lubricate the moving parts of the compressor.

During assembly, the control valve 49 is inserted, cap first, in the hole 18. Thus, the cap 79 is likely to hit the opening and the inner wall 18*a* of the hole 18. However, the protector 100, which is attached to the cap 79, prevents the cap 79 from directly hitting the opening and the inner wall 18*a*. Thus, the cap 79 is not deformed when mating the valve 49 with the compressor. As a result, the bellows 87 is maintained at the predetermined position. Therefore, the valve 49 has a desired operational characteristics. Displacement of the bellows 87 would hinder the movement of the bellows 87 and the valve body 74. However, the construction of the control valve 49 shown in FIG. 2 prevents displacement of the bellows 87, which results in accurate displacement control. The reliability of the compressor is thus improved.

Further, the protector 100 prevents the cap 79 from hitting other things when the control valve 49 is being carried, prior to installation. That is, the cap 79 is not deformed when the valve 49 is being carried, and the performance of the valve 49 is not degraded.

The protector 100 extends above the distal end of the cap 79 and protects the cap's distal end, which is most likely to hit something. The protector 100 therefore effectively prevents the cap 79 from being deformed.

The outer diameter of the protector 100 of the cap 79 is larger than the outer diameter of the cap's large diameter portion 82. Therefore, as shown in FIG. 3(*b*), the outer circumferential surface of the large diameter portion 82 is radially inside of the protector 100. The protector 100 therefore prevents the larger diameter portion 82 from hitting objects as well.

The protector 100 has the projections 102, which face the inner wall 18*a* of the hole 18. Dimensional errors of the control valve 49 and the hole 18 or errors produced by assembling the valve 49 with the hole 18 may cause the protector 100 to contact the inner wall 18*a* of the hole 18. In this case, the clearance defined by the projections 102 allows gas flow along the inner wall 18*a*. In other words, even if the protector 100 contacts the inner wall 18*a*, the opening 50*a* of the introduction passage 50 remains unobstructed.

Since each projection 102 has a semi-circular cross-section, the area of contact is very narrow and is almost linear if a projection 102 contacts the inner wall 18*a*. Therefore, even if one of the projections 102 contacts a part of the inner wall 18*a* including the opening 50*a* of the passage 50, the projection 102 does not hinder the gas flow through the opening 50*a*. Thus, the pressure in the suction passage 32 is positively communicated with the pressure sensing chamber 84 by the passage 50. This allows the bellows 87 to accurately respond to the pressure in the suction passage 32. The reliability of the control valve 49 is improved, accordingly. In other words, the position of each projection 102 relative to the opening 50*a* does not need to be considered. This facilitates the assembly of the protector 100.

The projections 102 extend along the axis S of the protector 100. Therefore, the protector 100 is easily extruded along its axial direction. The projections 102 are spaced at equal angular intervals about the axis S. This construction facilitates the manufacture of the protector 100.

The distance between the top wall 81 of the cap 79 and the bottom surface 18*b* of the hole 18 is shorter than the axial length of the protector 100. Therefore, even if the protector 100 is displaced, the protector 100 contacts the inner wall 18*b* of the hole 18 and is not disengaged from the cap 79. In other words, the protector 100 does not chatter in the space 85.

Figure 4:
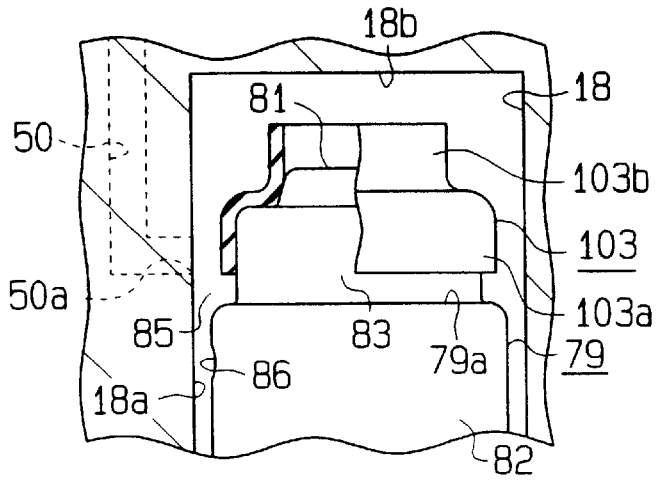
FIG. 4 is an enlarged partial front view like FIG. 3(*a*), with a part cut away, illustrating a protector according to a second embodiment of the present invention.

The present invention may be alternatively embodied in the following forms:

The shape of the protector may be altered. FIG. 4 illustrates a protector 103 according to a second embodiment of the present invention. The protector 103 has a proximal portion 103*a* and a distal portion 103*b*. The proximal portion 103*a* is fitted to the cap's small diameter portion 83 and the diameter of the distal portion 103*b* is smaller than that of the proximal portion 103*a*. This distal portion 103*b* decreases the exposed area of the cap's distal portion and thus effectively protects the cap's distal portion. The distal portion 103*b* also facilitates the insertion of the valve 49 into the hole 18. The distal portion 103*b* may be tapered. Further, the protector 103 may have projections like the projections 102 of the embodiment of FIGS. 1–3(*b*).

Figure 5:
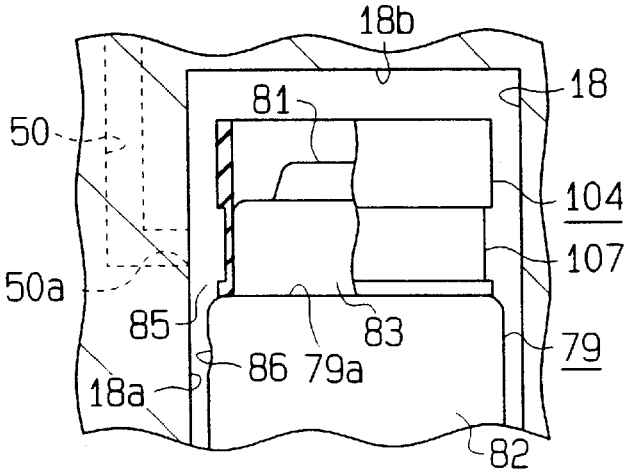
FIG. 5 is an enlarged partial front view like FIG. 4, with a part cut away, illustrating a protector according to a third embodiment of the present invention.

FIG. 5 illustrates a protector 104 according to a third embodiment of the present invention. The protector 104 has an annular recess 107 at a part corresponding to the opening 50*a* of the introduction passage 50. Therefore, if the protector 104 contacts the inner wall 18*a* of the hole 18, the clearance created by the recess 107 allows gas flow through the opening 50*a*. In other words, the protector 104 does not close or obstruct the opening 50*a*.

Figure 6:
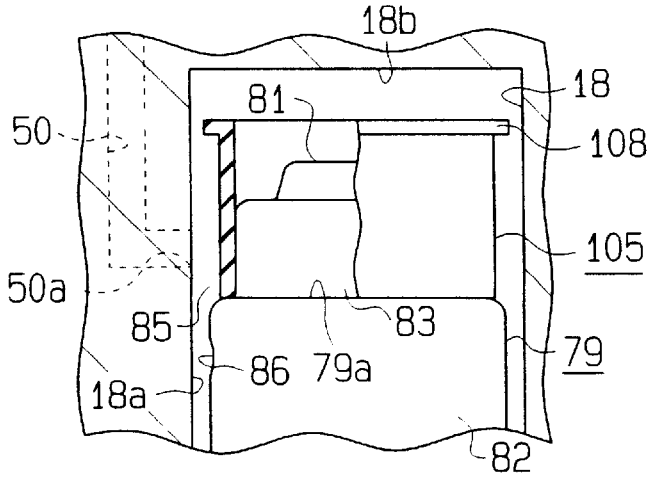
FIG. 6 is an enlarged partial front view like FIG. 4, with a part cut away, illustrating a protector according to a fourth embodiment of the present invention.
Figure 7:
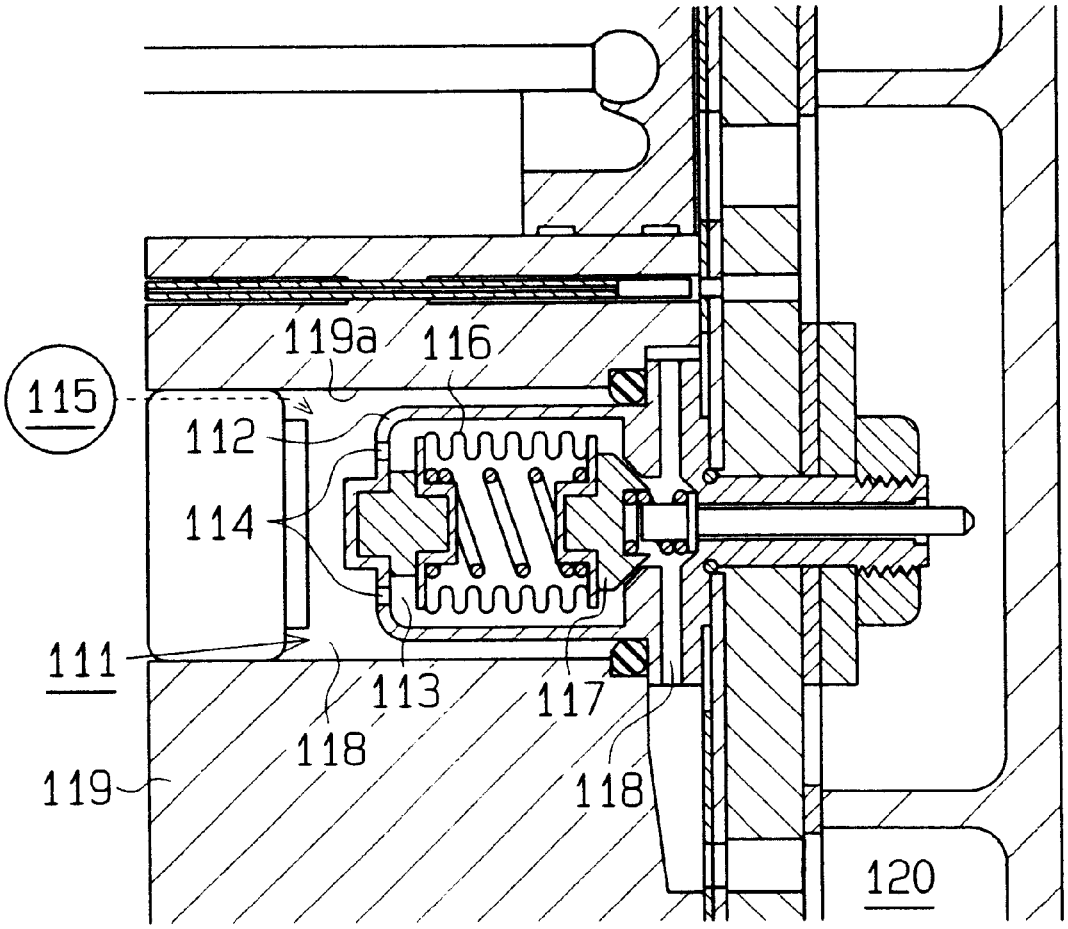
Fig.7 (Prior Art)
FIG. 7 is a cross-sectional view illustrating a prior art compressor.

FIG. 6 illustrates a protector 105 according to a fourth embodiment of the present invention. The protector 105 has an annular projection 108, or flange, at its distal end. The projection 108 functions in the similar manner to the projections 102 of the embodiment of FIGS. 1–3(*b*) and has the same advantages.

The cap 79 may be coated with rubber or resin and this coating may function as a protector.

The cap's large diameter portion 82, as well as the small diameter portion 83, may be covered by a protector.

The projections 102 need not be parallel the axis S. For example, the projections 102 may be replaced by a number of dot-like projections.

The variable displacement compressor of FIG. 1 uses the control valve 49 to control the flow rate of gas from the discharge chamber 39 to the crank chamber 15. However, the present invention may be embodied in a variable displacement compressor that uses a control valve to control the flow rate of gas from a crank chamber to a suction chamber. Further, the present invention may be embodied in a variable displacement compressor that uses control valves to control the flow rate of gas introduced to a crank chamber and the flow rate of gas discharged from the crank chamber.

Therefore, the present examples and embodiments are to be considered as illustrative and not restrictive and the invention is not to be limited to the details given herein, but may be modified within the scope and equivalence of the appended claims.

What is claimed is:

1. A control valve in a variable displacement compressor that adjusts the discharge displacement in accordance with the inclination of a drive plate located in a crank chamber, wherein the compressor includes a piston connected to the drive plate, the piston being located in a cylinder bore, wherein the inclination of the drive plate varies according to the difference between the pressure in the crank chamber and the pressure in the cylinder bore, wherein the control valve regulates the difference between the pressure in the crank chamber and the pressure in the cylinder bore in accordance with an operating pressure, which is the pressure in a selected chamber of the compressor, the control valve comprising:

a housing body;

a valve body movably accommodated in the housing body to adjust the valve opening amount;

a cap attached to the housing body to define a pressure chamber, wherein the pressure chamber is exposed to the operating pressure;

a pressure sensing member located in the pressure chamber, wherein the pressure sensing member moves the valve body in accordance with the operating pressure in the pressure chamber; and a protector attached to the cap to protect the cap from impact.

2. The control valve according to claim 1, wherein the compressor includes a housing that has a accommodating hole to accommodate the control valve, and wherein the cap of the control valve is inserted first into the accommodating hole during assembly.

3. The control valve according to claim 2, wherein the accommodating hole is a cylindrical blind hole having a bottom surface and a circumferential wall, wherein the cap has a distal surface, which faces the bottom surface, and an outer circumference surface, which faces the circumferential wall, wherein a space is defined between the accommodating hole and the cap, wherein the compressor has a gas introduction passage by which the space is connected to the selected chamber, and wherein the cap has a port to connect the pressure chamber with the space.

4. The control valve according to claim 3, wherein the protector is generally tubular, is fitted to the outer circumferential surface of the cap, and has an outer circumferential surface that faces the circumferential wall of the accompanying hole.

5. The control valve according to claim 4, wherein the gas introduction passage opens to the accommodating hole, wherein the protector is formed and arranged to define a clearance between the protector and the circumferential wall of the accommodating hole thereby preventing obstruction of the opening.

6. The control valve according to claim 5, wherein the protector has a projection on its outer circumferential surface.

7. The control valve according to claim 6, wherein the projection is linear and extends parallel to the axis of the protector.

8. The control valve according to claim 7, wherein the projection has a semi-circular cross-section.

9. The control valve according to claim 7, wherein the linear projection is one of a plurality of linear projections that are located about the axis of the protector.

10. The control valve according to claim 9, wherein the linear projections are spaced at equal angular intervals about the axis of the protector.

11. The control valve according to claim 6, wherein the projection is a flange.

12. The control valve according to claim 5, wherein the protector has an annular recess in its outer circumferential surface, and wherein the annular recess is radially aligned with the opening of the gas introduction passage.

13. The control valve according to claim 4, wherein the protector includes a first portion, which is fitted about the circumferential surface of the cap, and a second portion, which extends axially further beyond the distal surface of the cap.

14. The control valve according to claim 13, wherein the second portion has a smaller diameter than that of the first portion.

15. The control valve according to claim 4, wherein the axial length of the protector is greater than the distance between the distal surface of the cap and the bottom surface of the accommodating hole.

16. The control valve according to claim 1, wherein the protector is made of an elastomeric material.

17. A control valve that regulates the amount of gas flowing in a gas passage in accordance with an operating pressure introduced into the control valve, the control valve comprising:

a housing body;

a valve body movably accommodated in the housing body to adjust the opening amount of the gas passage;

a cap attached to the housing body to define a pressure chamber, wherein the pressure chamber is exposed to the operating pressure;

a pressure sensing member located in the pressure chamber, wherein the pressure sensing member moves the valve body in accordance with the operating pressure in the pressure chamber; and a protector attached to the cap to protect the cap from impact.

18. The control valve according to claim 17, wherein the protector is a tubular member made of an elastic material.

19. The control valve according to claim 18, wherein the protector includes a plurality of linear projections, which are formed on the outer circumferential surface of the protector and extend parallel to the axis of the protector.

20. The control valve according to claim 18, wherein the protector includes a first portion, which is fitted about the cap, and a second portion, which extends further beyond the cap.

* * * * *